US005951071A

United States Patent [19]

Elliott

[11] Patent Number: 5,951,071

[45] Date of Patent: Sep. 14, 1999

[54] DOOR BRACE

[76] Inventor: James Elliott, 150 1st Ave., Arnprior, Ontario, Canada, K7S 1W5

[21] Appl. No.: 08/763,522

[22] Filed: Dec. 11, 1996

Related U.S. Application Data

[63] Continuation-in-part of application No. 08/629,483, Apr. 11, 1996, abandoned.

[51] Int. Cl.[6] ..... E05C 17/44

[52] U.S. Cl. ..... 292/338; 292/262; 292/278; 292/DIG. 15

[58] Field of Search ..... 292/338, 339, 292/DIG. 15, 262, 278, 263, 275; 254/39; 248/229.16, 229.26, 354.1, 354.6

[56] References Cited

U.S. PATENT DOCUMENTS

| | | | |
|---|---|---|---|
| 1,601,524 | 9/1926 | Gibbons | 292/262 |
| 1,695,686 | 12/1928 | Hess . | |
| 2,475,548 | 7/1949 | Kearns | 248/354.6 |
| 2,643,420 | 6/1953 | Schwartz | 292/262 |
| 3,110,506 | 11/1963 | O'Brien | 248/354.1 |
| 3,583,743 | 6/1971 | Newell | 292/339 |
| 4,070,049 | 1/1978 | Brewer . | |
| 4,194,264 | 3/1980 | Stoffregen | 292/278 |
| 4,789,123 | 12/1988 | Mattsson | 292/338 |
| 5,040,835 | 8/1991 | Barker . | |
| 5,131,701 | 7/1992 | Stepniewski . | |
| 5,503,443 | 4/1996 | Tautfest . | |

FOREIGN PATENT DOCUMENTS

| | | | |
|---|---|---|---|
| 630304 | 12/1927 | France | 292/338 |
| 2188676 | 10/1987 | United Kingdom . | |
| 2193247 | 2/1988 | United Kingdom | 292/338 |
| 2253652 | 9/1992 | United Kingdom | 292/339 |
| 2271804 | 4/1994 | United Kingdom | 292/338 |
| WO 81/01586 | 6/1981 | WIPO . | |

*Primary Examiner*—Darnell M. Boucher
*Attorney, Agent, or Firm*—Pearne, Gordon, McCoy & Granger LLP

[57] ABSTRACT

A door brace for bracing a door against a fixed object and for controlling the opening and closing of the door includes an elongate member of variable length, extendable and retractable between a first length and a second length; a first anchor means constructed and arranged to secure a first end of the elongate member to a door; a second anchor means constructed and arranged to secure a second end of the elongate member to a fixed object; and control means for forcefully extending the elongate member from the first and toward the second length. The door is at least partially open when the elongate member is at the first length, and closed when the elongate member is at the second length.

9 Claims, 10 Drawing Sheets

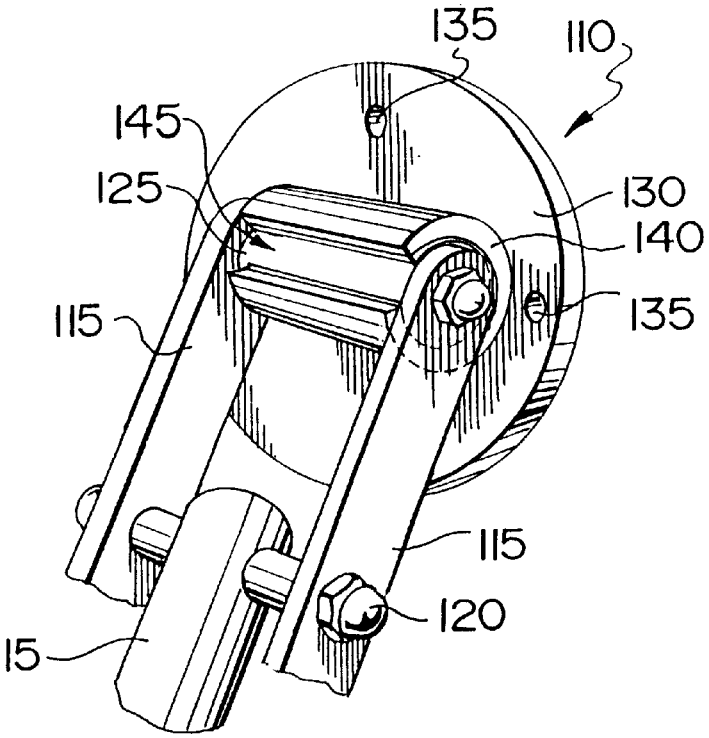
FIG.5
FIG.4
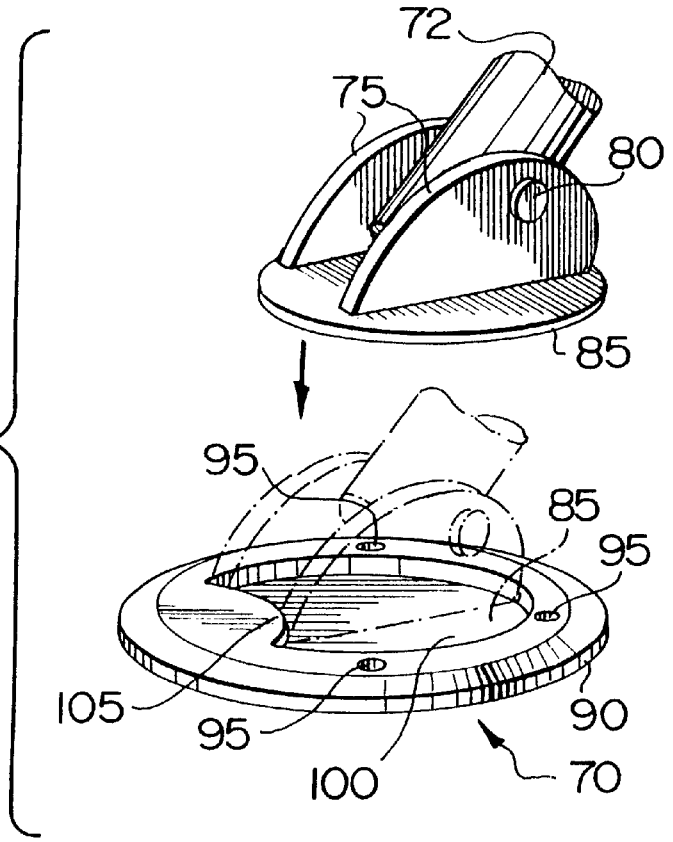

DOOR BRACE

This is a continuation-in-part of application Ser. No. 08/629,483, filed Apr. 11, 1996 now abandoned.

FIELD OF INVENTION

This invention relates to a brace for securing a door in either a closed, or a partially open position, and for moving the door securely and forcefully from a partially open position to a closed position.

BACKGROUND OF THE INVENTION

To protect people and valuables in buildings or rooms against forced entry, lockable doors are used. Various types of locks may be used to secure a door in the closed position. Typically, a lock secures the free edges of the door to the door frame using one or more deadbolts. Such a lock provides no support for the door itself, and the central portion of the door may be broken if subjected to blows. Such a lock also must be completely disengaged in order partially to open the door, and once the door is partially opened (for example, when an occupant wishes to speak to someone at the door or to receive a package), it is relatively easy for an intruder to force the door open further to gain entry.

To brace the door and to secure the door in the closed position, a cross brace may be placed horizontally across the door and secured on either side of the door to the door frame or wall.

Alternatively, an angle brace may be used to support the door and to secure it in the closed position. One end of the angle brace is attached to the door at a distance from the free vertical edge of the door, typically near the door handle. The other end of the angle brace is attached to the floor at a distance from the door such that the angle brace lies at an angle sufficient to brace the door shut. An angle brace may be constructed so as to be adjustable in length by using a tube or bar that is slidable within a second tube of slightly larger diameter. A series of holes are drilled through both, and a pin or bolt is placed through matching holes to fix the length of the angle brace before attaching it to the door or floor.

However, like conventional locks, cross braces and angle braces must be disengaged prior to partial opening of the door.

To secure the door in a partially open position, a door chain may be used. However, a door chain is generally not strong enough to withstand a forceful blow. If the chain used is strong enough, it is usually impossible to attach the chain strongly enough to the door and door frame to withstand a forceful blow to the door. Another limitation of a door chain is that it provides no support to the door, and it can be severed once the door is partially opened.

A door stop may also be used to prevent a door from moving. While it is possible to build a door stop that will withstand forceful blows to the door, the door itself is placed in a weak position since it is supported only by its hinges and by the door stop under the lower edge of the door.

SUMMARY OF THE INVENTION

The present invention provides a door brace for securing and bracing a door in the closed position, which also allows the door to be partially opened without disengaging the brace. The door brace of this invention also secures and braces a door in a partially open position.

The door brace of this invention, in one embodiment, in addition to securing and bracing a door, will also assist in forcefully closing the door, and can be constructed so that relatively little force is applied by the operator of the door brace.

The door brace of this invention, in an alternative embodiment, will continuously apply a closing force on a door following an initial input of a relatively small closing force applied by the operator of the invention.

The door brace of this invention can also be constructed so that it will absorb the shock of forceful blows administered to a partially open door.

In a further embodiment, the door brace of this invention will automatically apply a closing force on a partially open door if a forceful blow is administered to the door.

Thus, in a first broad embodiment, this invention seeks to provide a door brace for bracing a door against a fixed object and for controlling the opening and closing of the door, comprising in combination: an elongate member of variable length, extendable and retractable between a first length and a second length; a first anchor means constructed and arranged to secure a first end of the elongate member to the door; a second anchor means constructed and arranged to secure a second end of the elongate member to a fixed object; and control means for forcefully extending the elongate member from the first and toward the second length; wherein the door is at least partially open when the elongate member is at the first length, and closed when the elongate member is at the second length.

In a second broad embodiment, this invention seeks to provide a door brace for bracing a door against a fixed object, comprising: an elongate member of variable length, extendable and retractable between a first retracted length and second extended length; a first anchor means constructed and arranged to secure a first end of the elongate member to a door; a second anchor means constructed and arranged to secure a second end of the elongate member to a fixed object; and means for securing the elongate member in either the first retracted length or the second extended length; wherein the door is at least partially open when the elongate member is at the first retracted length, and closed when the elongate member is at the second extended length.

BRIEF DESCRIPTION OF THE DRAWINGS

Embodiments of the invention will now be described with reference to the accompanying drawings, in which:

FIG. 4 is a perspective view of the foot assembly of the door brace of FIG. 1;

FIG. 5 is a perspective view of the head assembly of the door brace of FIG. 1;

Figure 1:
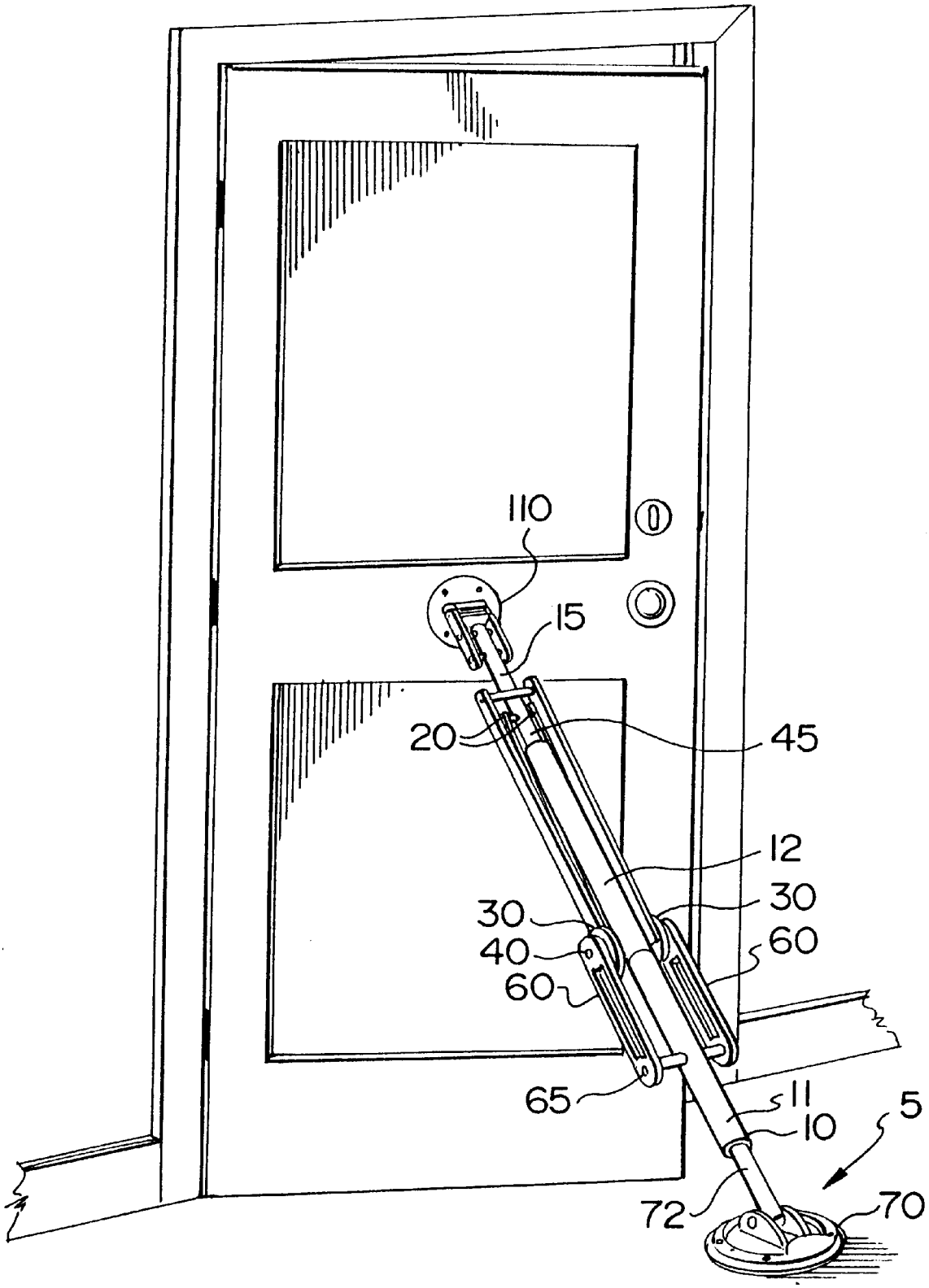
FIG. 1 is a perspective view of a door brace in the retracted position, attached to a door and to a floor.

Similar references are used in the FIGs. to denote similar components.

DETAILED DESCRIPTION OF THE INVENTION

Referring to FIGS. 1 through 5, a door brace 5 includes an outer tube 10 and an inner bar 15. The outer tube 10 includes two tubular sections 11 and 12, which are rigidly but detachably attached together to function as one tube. The two tubular sections 11 and 12 are detachable for easy packaging and shipping. The inner bar 15 is a sliding fit within the tube 10. The common axis of the outer tube 10 and inner bar 15 is indicated at 17.

Each of two connectors 20 is attached at one end to the inner bar 15 with a first pin 25, and at the other end to one of two discs 30 with a second pin 35. The discs 30 are rotatably attached to the outer tube 10 through the axle 40. Preferably, the axle 40 is rotatably mounted within a sleeve (not shown) which passes through and is attached to the outer tube 10. Rotation of the discs 30 causes movement of the connectors 20, in turn causing axial movement of the inner bar 15 relative to the outer tube 10. Alternatively, the brace 5 could, for example, be designed with one disc 30 and one connector 20. However, the double disc design of the illustrated embodiment is advantageous in that it is balanced, strong and facilitates smooth movement of the discs 30 and connectors 20, even under conditions where great force is exerted on the brace 5. Embodiments could be designed with more than two discs 30, or could incorporate a gearing mechanism.

A lever 45 includes two parallel arms 50, each of which is attached at one end to a handle 55, and at the other end to the axle 40. The lever 45 is thus rotatable about the axle 40. However, each of the two arms 50 is also attached to the adjacent disc 30 with a fastener 48 which is located at a distance from the axle 40. Rotation of the lever 45 about the axle 40 causes the discs 30 to rotate, which in turn causes axial movement of the inner bar 15 relative to the outer tube 10, as described above.

Attached to the outer tube 10 at a distance from the discs 30 is a third pin 65. Each of two elongate elastic rubber tensioners 60 is attached at one end to the third pin 65, and at the other end to the adjacent disc 30 with a fastener 68 which is located at a distance from the axle 40. The fasteners 68 are located on the discs 30 such that rotation of the lever 45 so as to retract or shorten the brace 5 (i.e. slide the inner bar 15 further into the outer tube 10) causes the tensioners 60 to be stretched. In this way, the lever 45 is biased towards the position in which the brace 5 is extended to its full length. The strength of the bias of the lever 45 will depend on the characteristics of the tensioners 60 and on the position of the fasteners 68 relative to the axle 40, since the position of the fasteners 68 determines the bias applied to the lever 45. The fasteners 48 and fasteners 68 may be variously positioned on the discs 30 to achieve desired performance characteristics of the brace 5, as will be described in more detail below.

Figure 2:
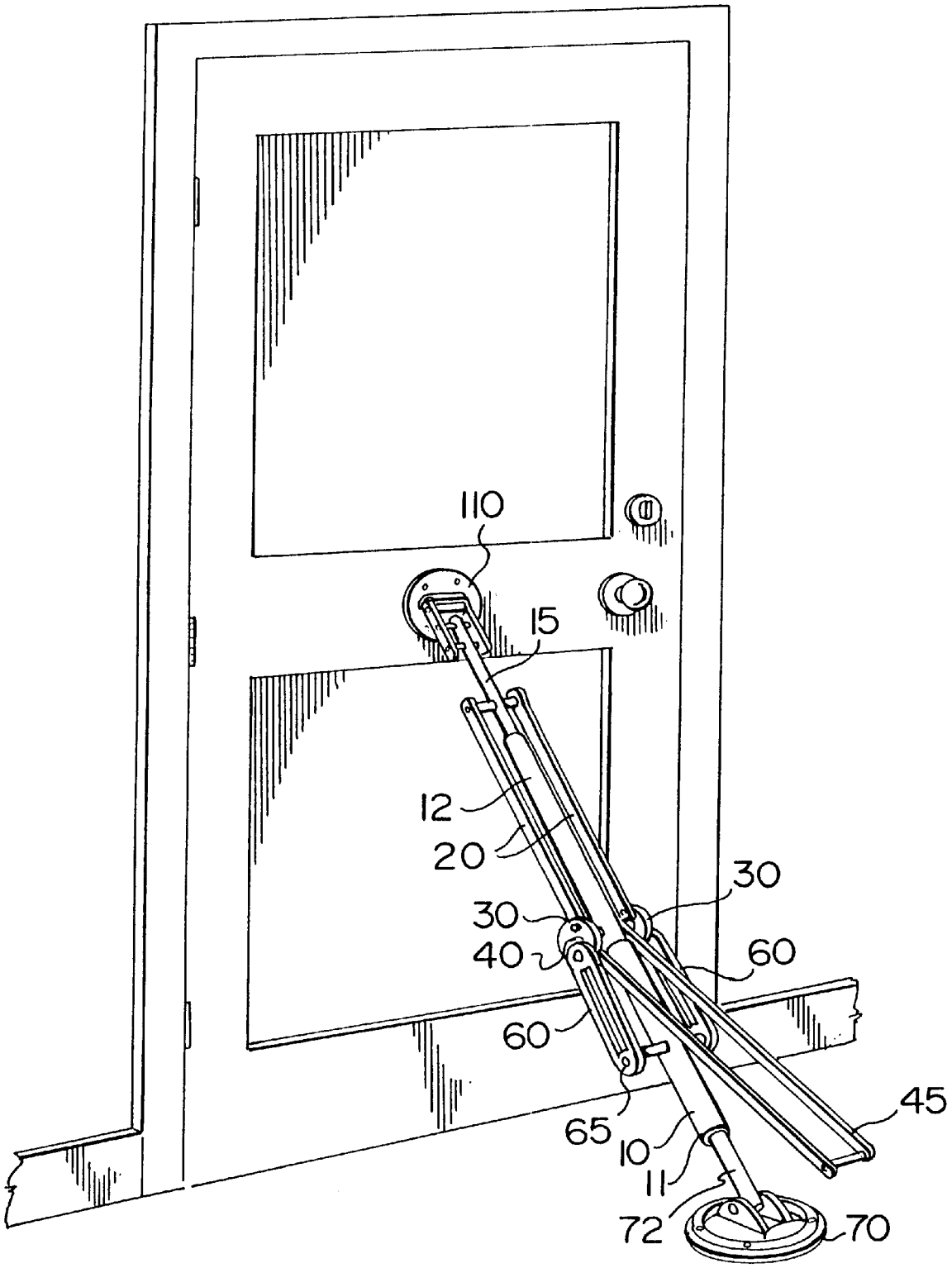
FIG. 2 is a perspective view of the door brace of FIG. 1 in the extended position.
Figure 3:
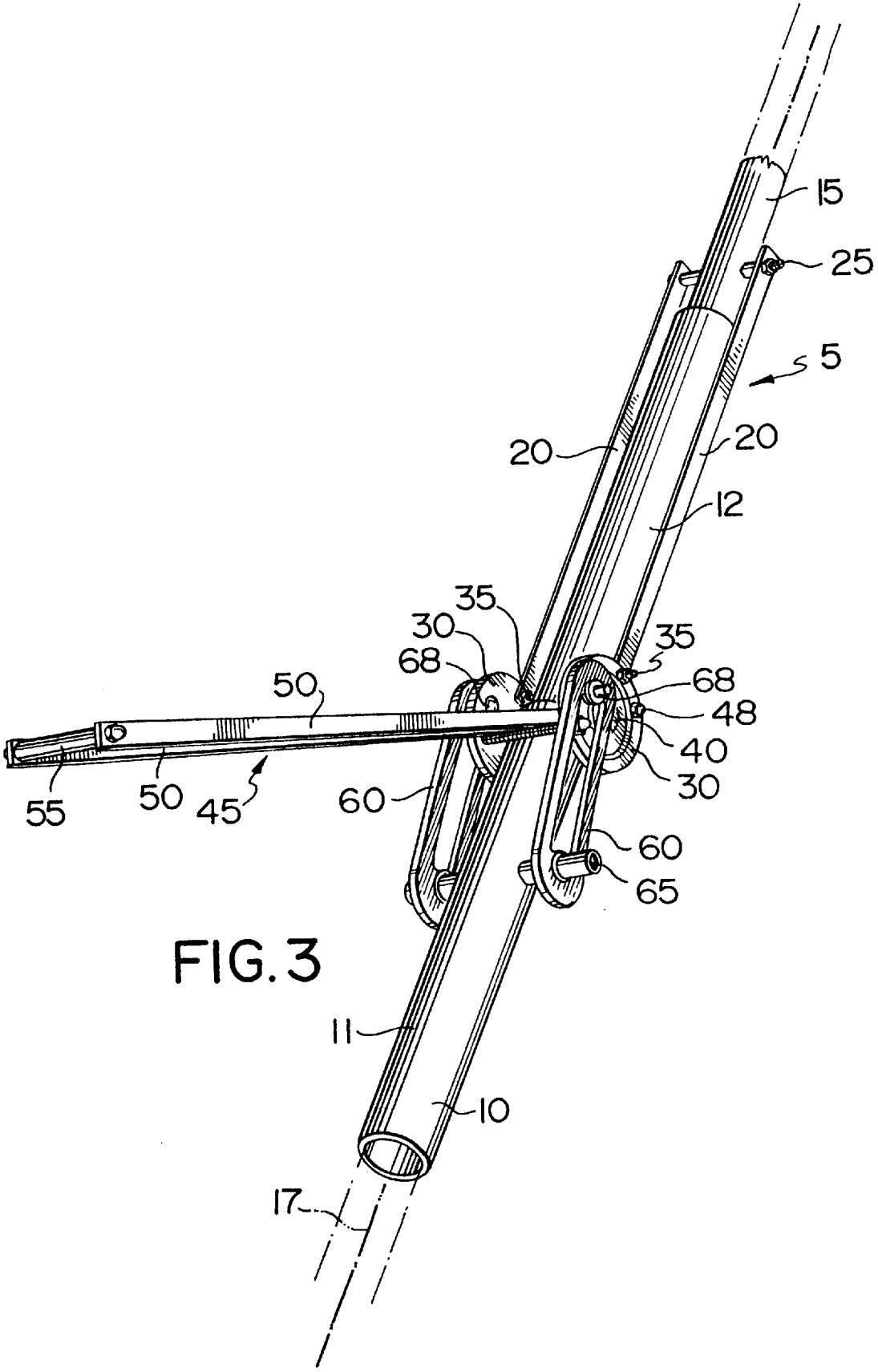
FIG. 3 is a partial perspective view the door brace of FIG. 1 without the head and foot assemblies.

The outer tube 10 is attached to a foot assembly 70 shown in FIG. 4. The foot assembly 70 is shown in FIGS. 1 and 2 secured to a floor; however, it can be attached to any other suitable fixed object. A connecting bar 72 is rigidly attached to t he outer tube 10 and rotatably attached to t wo curved vertical members 75 with a fourth pin 80. The vertical members 75 are rigidly and perpendicularly mounted to a circular horizontal member 85. A circular base 90 is attached to the floor with, for example, screws or bolts (not shown) through holes 95. The base 90 may be recessed into the floor so that it will be unobtrusive when the door brace 5 is not in use. When the base 90 is mounted to the floor, it is positioned such that the arcuate lip 105 which protrudes over the cylindrical cavity 100 is furthest from the door. The arrangement of the various elements of the foot assembly 70 is such that the horizontal member 85 is easily insertable into, and easily removable from, the cavity 100, in a substantially vertical direction. However, when the brace 5 is attached to the door and the floor, the angle between the outer tube 10 and the floor is such that the horizontal member 85 cannot be removed from the cavity 100. Thus, when the brace 5 is in operation, the foot assembly 70 is securely attached to the floor. When the brace 5 is not in use only the base 90 is attached to the floor.

Figure 6:
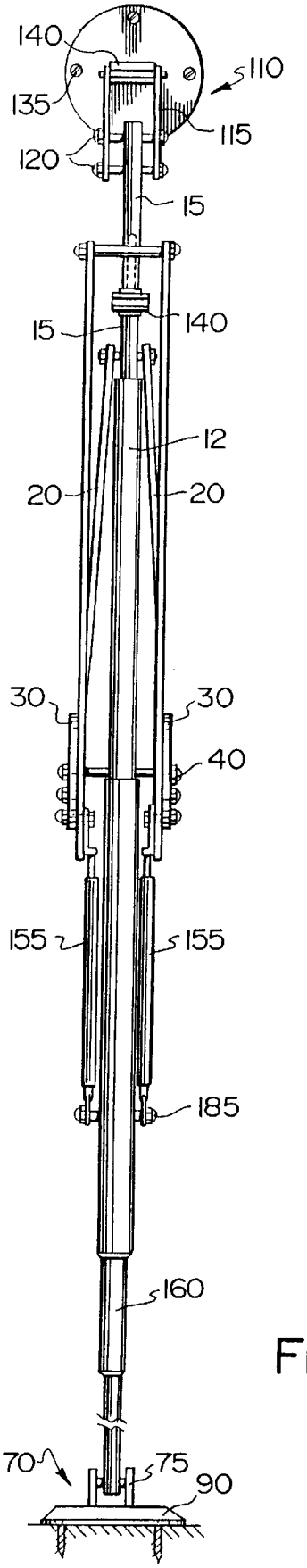
FIG. 6 is a top plan view of a second door brace in the retracted position.

Referring to FIGS. 5 and 6, attached to the inner bar 15 is a head assembly 110 adapted to attach to the door, which includes two arms 115 which are rigidly attached to the inner bar 15 with bolts 120. The arms 115 extend past the end of the inner bar 15. An axle 125 is attached to the free ends of the arms 115. The head assembly 110 also includes a circular plate 130, which is attachable to a door with conventional fasteners (not shown), through the holes 135. Rigidly mounted on the plate 130 is a substantially cylindrical hook 140, which includes a horizontal opening 145 adapted to receive the axle 125. The interior of the hook 140 includes a protrusion (not shown) which allows the axle 125 to "snap" into the hook 140. Once the axle 125 has been inserted or snapped into the hook 140, there is sufficient movement of the axle 125 within the hook 140 to allow the angle of the inner bar 15 relative to the door to change, such as will occur when the brace 5 is retracted and the door is opened.

To install the door brace 5, the base 90 is attached to the floor at a suitable distance from the door, and the circular plate 130 is attached to the door, as illustrated in FIGS. 1 and 2. The horizontal member 85 is inserted into the cavity 100, to secure the foot assembly 70 to the floor. The axle 125 is inserted through the opening 145 into the hook 140, to secure the head assembly 110 to the door.

The position of the head assembly 110 largely determines the position of the base 90. If the head assembly 110 is attached to the door near the free vertical edge of the door, optimal leverage is provided to maintain the door in a closed position or for closing the door. If the head assembly 110 is attached to the door near the centre of the door, optimal bracing is provided to protect the door itself from external blows. The foot assembly 70 should preferably be positioned such that the brace 5 when in place is in a plane approximately perpendicular to the plane of the door in the closed position.

If the operator wishes partially to open the door, the brace 5 is retracted to the shorter length position, as illustrated in FIG. 1, by rotating the lever 45 towards the inner bar 15, which causes the discs 30 to rotate, and the connectors 20 to slide the inner bar 15 further into the outer tube 10. At the same time, the tensioners 60 are extended, thus increasing the force applied to the discs 30, and biassing the lever 45 towards the extended longer length position. Thus, some of the energy used by the occupant to move the lever 45 towards the retracted shorter length position is stored in the tensioners 60 for later use in forcefully closing the door. The tensioners 60 can be attached to the discs 30 so as either to lock lever 45 in the retracted position, or to urge the lever 45 towards the extended position even when the brace 5 is in the fully retracted position. Thus, by variously positioning the tensioners 60 on the discs 30, the brace 5 can be configured to exhibit desired performance characteristics.

The length of the brace 5 depends upon the position of the pin 35: by attaching the connectors 20 to the discs 30 at a point closer to the axle 40, the range of movement of both the inner bar 15 and the door is reduced, and the closing force exerted on the door is increased. Other performance characteristics of the brace 5 can also be controlled by variously positioning the pin 35, as will be apparent to those skilled in the art.

To close the door, the lever 45 is rotated to the extended position as shown in FIG. 2. As the arms 50 of the lever 45 are substantially longer than the distance between the fastener 35 and the axle 40, the force exerted on the handle 55 by the operator of the brace is magnified many times through the connector 20 to the inner bar 15. Consequently, relatively little effort is required on the handle 55 to close the door forcefully. In addition, the tensioners 60 assist in rotating the discs 30 towards the extended position, thus adding even more force to close the door.

Figure 7:
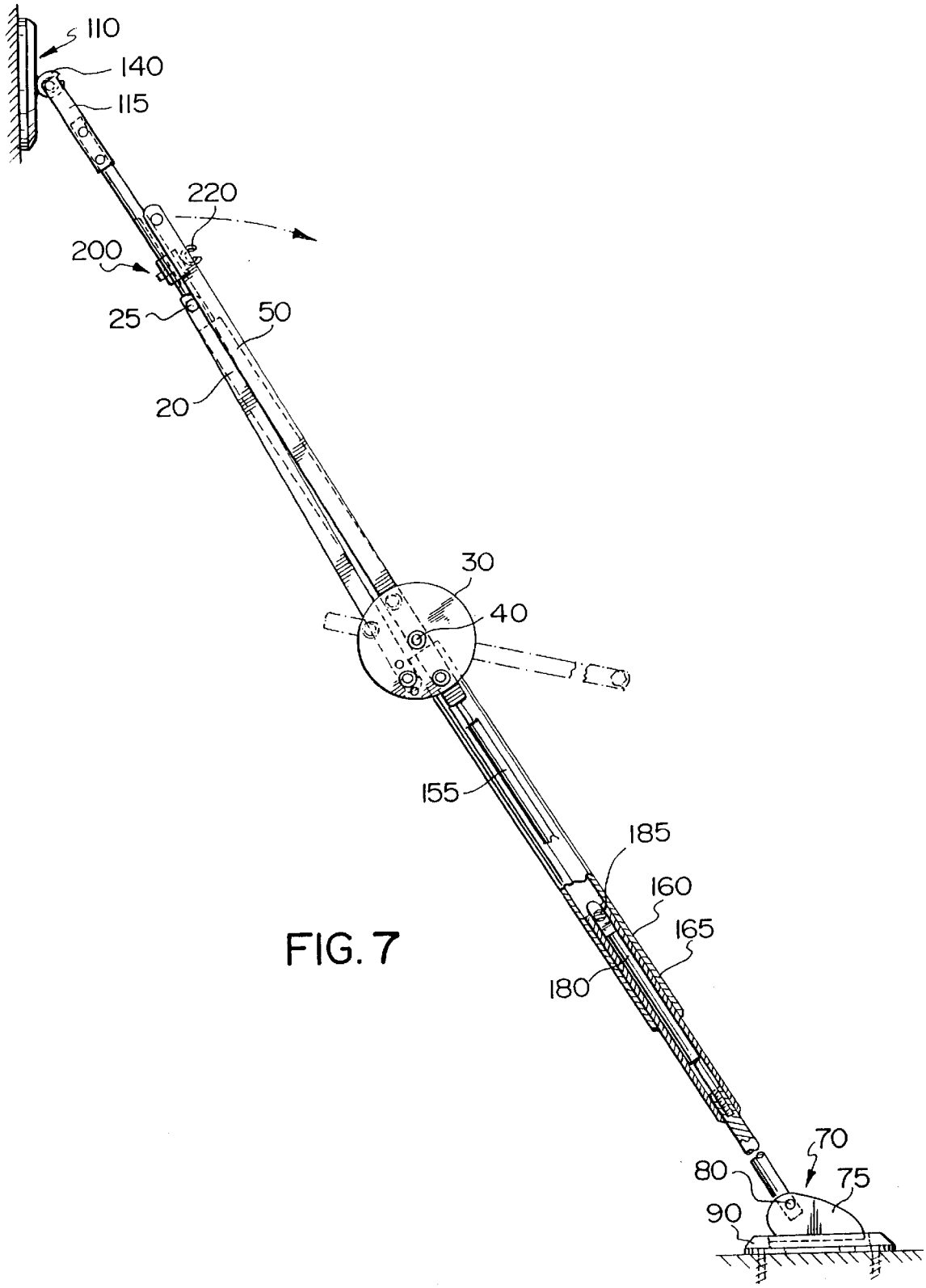
FIG. 7 is a side elevation view of the door brace of FIG. 6 in the retracted position.
Figure 10:
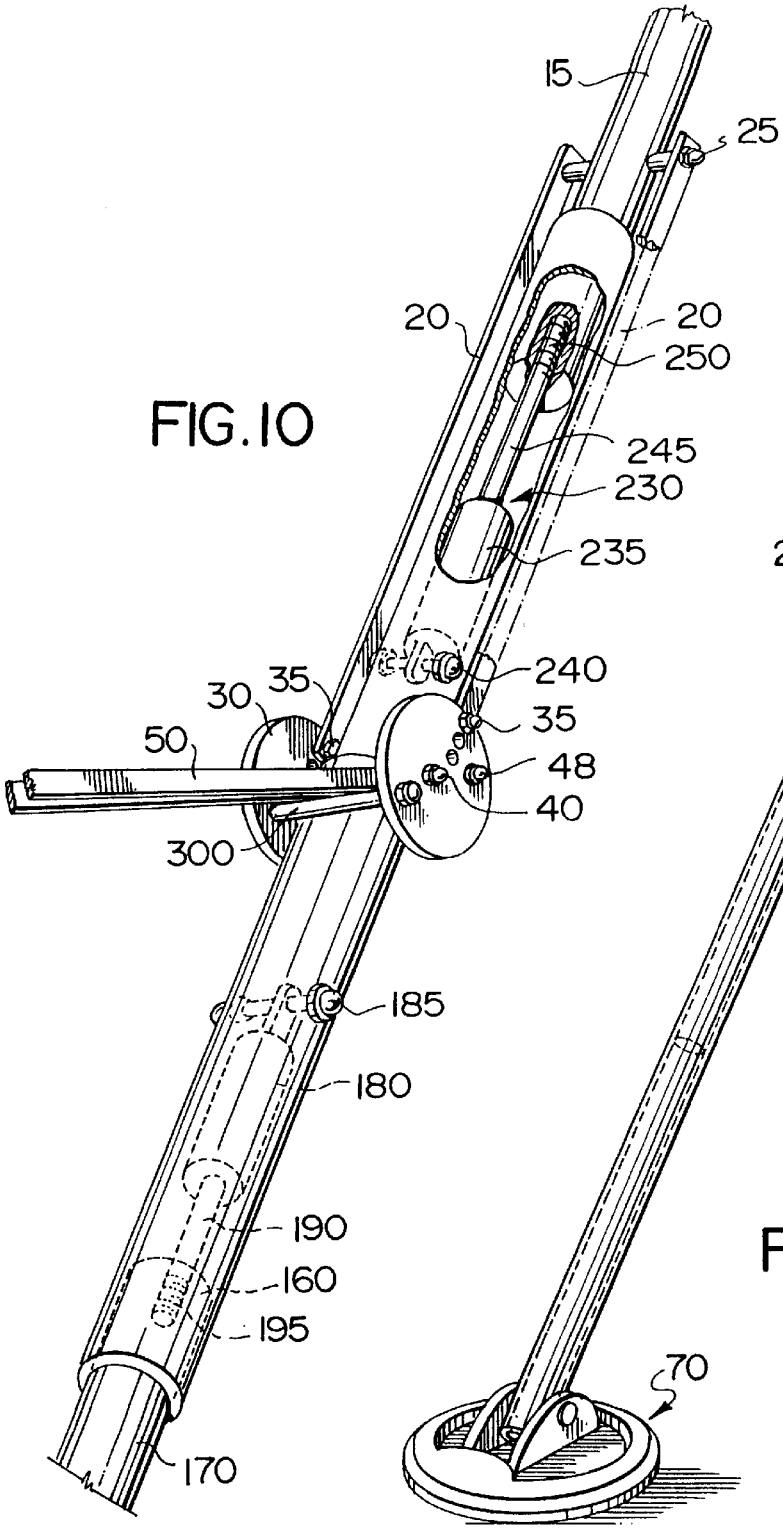
FIG. 10 is a partial perspective view of a third door brace without the head and foot assemblies.

Note that when the discs 30 are in the extended position, tile second pin 35 is aligned with the axle 40 along the common axis of the outer tube 10 and the inner bar 15. This arrangement is best illustrated in FIG. 7 (note that the arrangement of the connectors 20 and discs 30 of the second embodiment, illustrated in FIG. 7, is the same as that for the first embodiment). This arrangement ensures that the brace 5 will remain in the extended position if the door is subjected to blows, that is, the lever 45 will not move. Thus, an opening force exerted on the door will travel along the common axis 17, that is, through the head assembly 110, the inner bar 15, the connectors 20, the axle 40, the outer tube 10, the foot assembly 70, and finally to the floor. The lever 45 is also maintained in the extended position by the tensioners 60 or gas springs 155. A lever stop 300 spanning the discs 30, as shown in FIG. 10, may be used to prevent over rotation of the lever 45. Note that even when the discs 30 are close to the extended position, and the second pin 35 is not quite aligned with the axle 40 along the common axis of the outer tube 10 and the inner bar 15, an opening force exerted on the door will exert little rotational force on the discs 30. By contrast, force exerted on the lever 45 will be effective in applying a closing force to the door throughout the arc of rotation of the lever 45.

FIGS. 6 and 7 illustrate a door brace that includes two gas springs 155, in place of the rubber tensioners 60, which operate in a similar fashion to a combined spring and damper.

The gas springs 155 bias the brace 5 towards the extended longer length position, while at the same time rendering the movement of the lever 45 more controlled.

Figure 8:
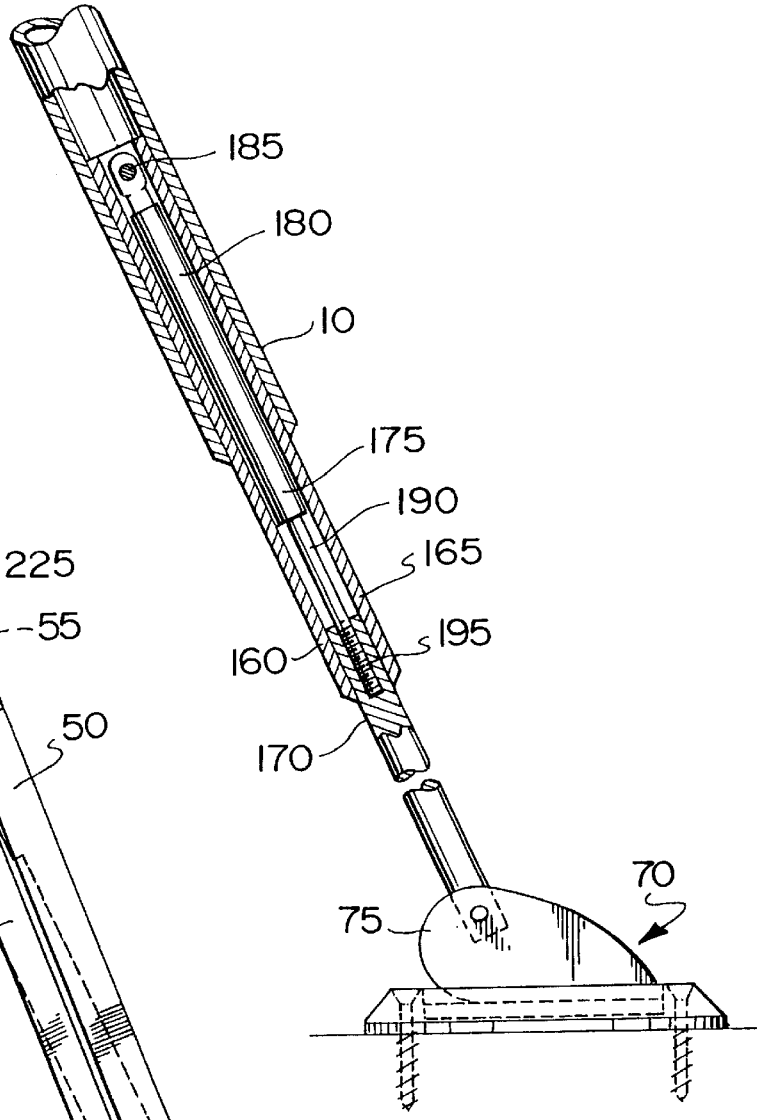
FIG. 8 is a side elevation view of part of the door brace of FIG. 6 showing the foot assembly.

In FIGS. 6, 7 and 8, an energy absorption and storage unit 160 is mounted in the outer tube 10, and includes a sleeve 165 inserted in the outer tube 10. The sleeve 165 extends from and is rigidly attached to the outer tube 10. A second inner bar 170 is inserted in the sleeve 165, which extends from, and is axially slidable within, the sleeve 165. The free end of the second bar 170 is rotatably attached to the vertical members 75 of the foot assembly 70 with fourth pin 80.

As shown in FIG. 8, the energy absorption and storage unit 160 includes a gas spring 175 which includes a cylinder section 180 attached to the sleeve 165 and outer tube 10 with a bolt 185 which passes through the sleeve 165 and outer tube 10. The gas spring 175 also includes a piston rod 190 which is attached to the second inner bar 170 at a threaded section 195.

If extreme force is being applied to a partially open door preventing closure, the lever 45 can still be rotated to the extended longer length position of the door brace 5: the inner bar 15 slides out from the outer tube 10 to its extended position, and the energy absorption and storage unit 160 compresses to allow for such movement, allowing the gas spring 175 to exert a continuous pressure on the door. Since the gas spring 175 can be very stiff, the continuous force exerted by the energy absorption and storage unit 160 on the door can be correspondingly large. As soon as the force decreases, the door is closed by the energy absorption and storage unit 160. A continuous closing force will still be exerted on the door even though the operator/occupant has moved away from the door. Another advantage is that the energy absorption and storage unit 160 will absorb the shock of sharp forceful blows administered to a partially open door, reducing the strain on the door and brace 5. The energy absorber will also cushion any force that may be transmitted to the door brace, thus facilitating operation of the brace under these severe conditions.

Figure 9:
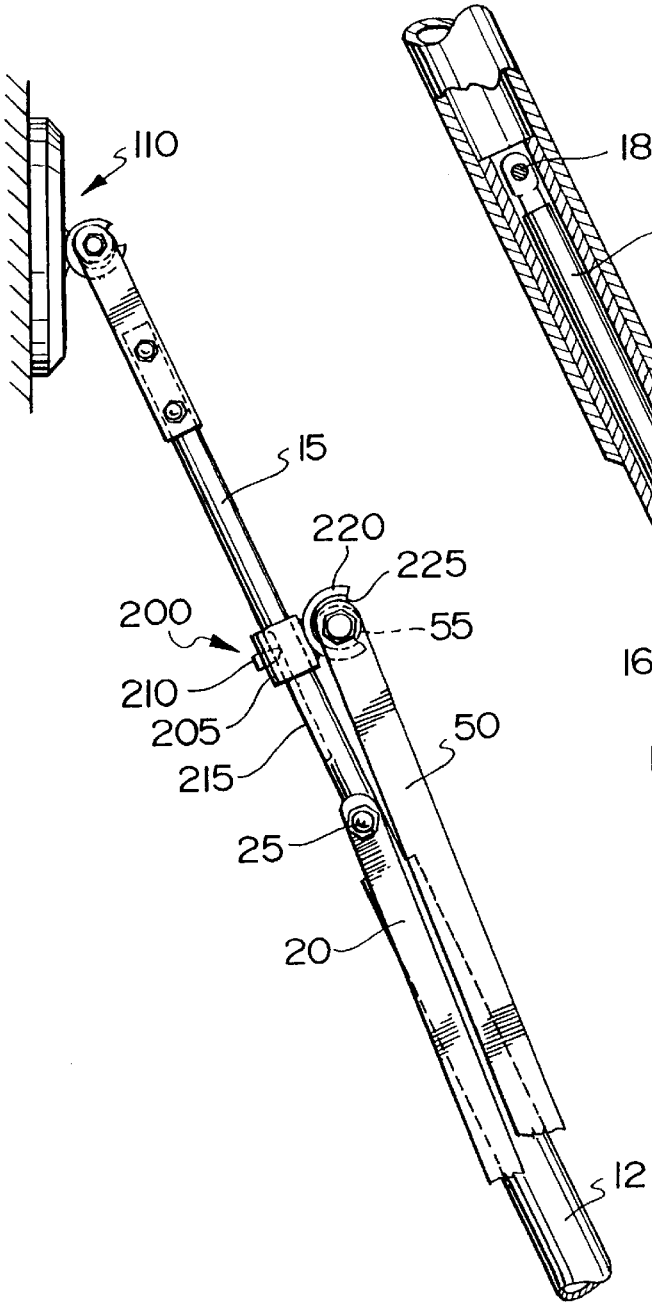
FIG. 9 is a side elevation view of part of the door brace of FIG. 6 showing the head assembly.

The door brace 5 as shown in FIGS. 6, 7 and 9 includes a lever restraining assembly 200 including a collar 205 which is slidable on the inner bar 15, but restricted to axial movement over a limited distance by the key 210, which passes through the collar 205 into the keyway 215. Attached perpendicularly to the collar 205 is a clip 220 lined with rubber 225.

During operation of the lever 45, the lever restraining assembly 200 can be positioned as in FIG. 9 such that the handle 55 of the lever 45 is clamped within the clip 220. In this configuration, the brace 5 is temporarily secured in the retracted shorter length position, even though the lever 45 may be biased towards the extended position by virtue of the arrangement of the gas springs 155, connectors 20 and discs 30. Note that the handle 55 may be easily pulled from the clip 220 by the operator.

However, during operation of the lever 45 (assuming that the brace 5 is installed), the gravitational force will position the lever restraining assembly 200 as shown in FIGS. 6 and 7. In this configuration, the lever restraining assembly 200 is not operational and hence unless restrained by the operator, the lever 45 will move towards the extended position. One advantage of this arrangement of the lever restraining assembly is as follows. It is possible in some embodiments of the invention that a very forceful blow, applied to the door when the lever 45 is in a position between the extended and retracted positions, could cause the lever 45 to rotate suddenly to the retracted position. In this case, since the lever restraining assembly 200 would not be operational, the lever would automatically move back towards the extended position once the force on the door was reduced. Thus, even without the operator being present, the brace 5 would automatically close the door due to the bias of the lever 45 towards the extended position.

Figure 12:
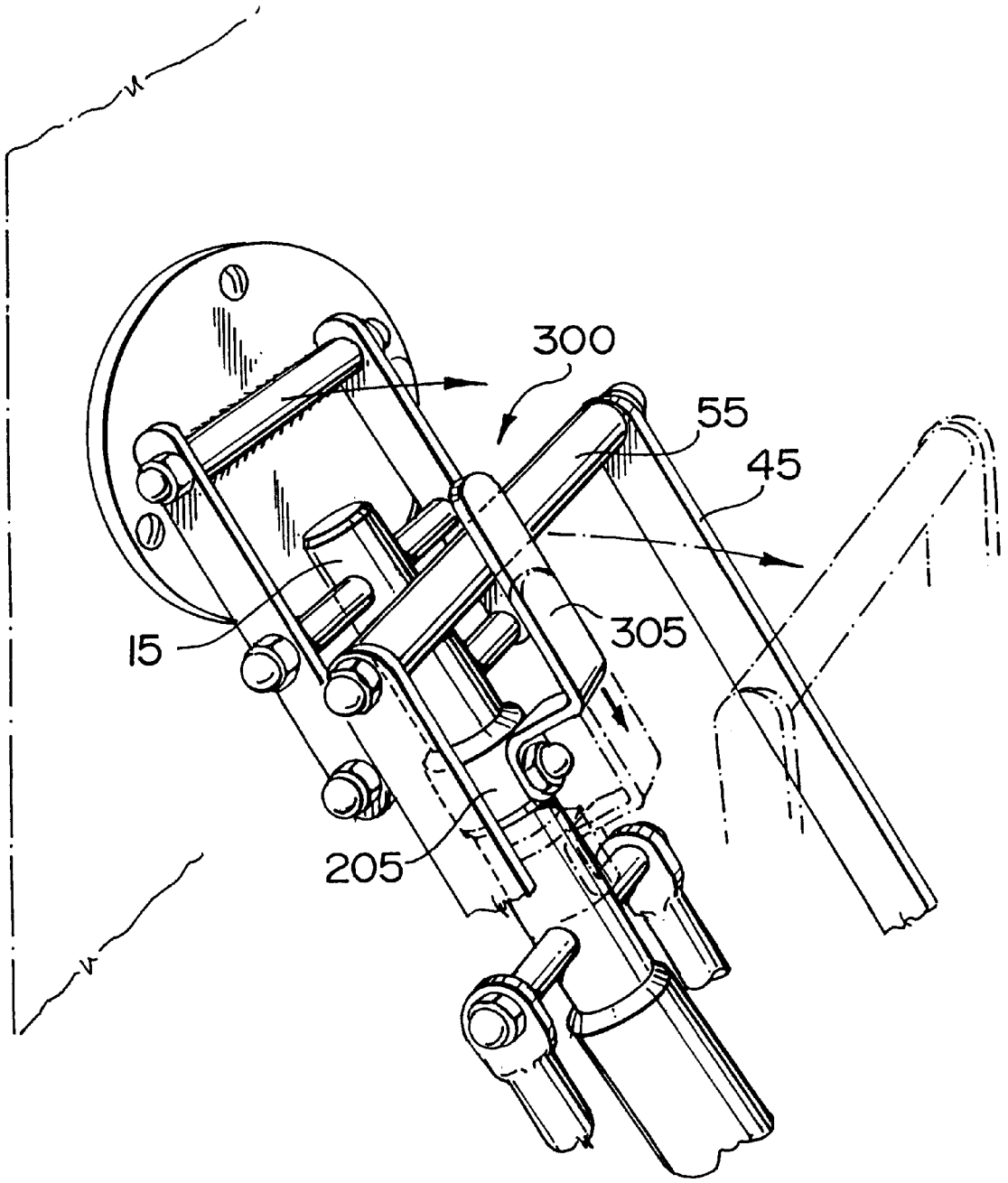
FIG. 12 is a perspective view of part of a fifth door brace.

An alternative lever restraining assembly 300 is illustrated in FIG. 12. Note that this embodiment is designed for use with a brace 5 in which the lever 45 is biased towards the extended position. As with the embodiment shown in FIGS. 6, 7 and 9, the lever restraining assembly 300 includes a collar 205 which is slidable on the inner bar 15, but restricted to axial movement over a limited distance by the key 210, which passes through the collar 205 into the keyway 215. Attached perpendicularly to the collar 205 in this embodiment is an L-shaped clip 305.

During operation of the lever 45, the lever restraining assembly 300 can be positioned as in FIG. 12 such that the handle 55 of the lever 45 is clamped by the L-shaped clip 305. The force exerted by the handle 55 on the L-shaped clip 305 causes the collar 205 to rotate slightly relative to the inner bar 15: the static frictional force thus generated between the collar 205 and the inner bar 15 prevents the collar 205 from sliding axially relative to the inner bar 15. Thus, in this configuration, the brace 5 is temporarily secured in the retracted shorter length position, even though the lever 45 may be biased towards the extended position by virtue of the arrangement of the gas springs 155, connectors 20 and discs 30. Note that the L-shaped clip 305 is only effective in securing the handle 55 as described above when the lever 45 is biased towards the extended position. Since it is the force exerted by the handle 55 on the L-shaped clip 305 that keeps the collar 205 from sliding down the inner bar 15, the operator need only move the handle 55 towards the inner bar 15 to disengage the lever restraining assembly 300. Once disengaged, the lever restraining assembly 300 slides down the inner bar 15 to rest in the position illustrated in broken lines in FIG. 12. Importantly, the L-shaped clip 305 is also disengaged from the handle 55 if a forceful blow is administered to a partially open door.

In operation, if the brace 5 is used to partially open a door inwards, as shown in FIG. 1, the L-shaped clip 305 can be slid up the inner bar 15 so as to engage the handle 55, as shown in FIG. 12. Since the lever 45 is biased towards the extended position, the handle 55 exerts pressure on the L-shaped clip 305, thus rotating the collar 205 and temporarily securing the lever restraining assembly 300 relative to the inner bar 15. If a forceful blow is administered to the outside of the door (e.g., by a person throwing their weight against the door), the brace retracts slightly, causing the handle 55 to move towards the inner bar 15, thereby releasing the clip 305 and causing the collar 205 to slide down the inner bar 15 to the lower end of the keyway 215. Once the blow has been administered to the door, the force exerted on the door decreases. The biased lever 45, which is no longer restrained by the L-shaped clip, then moves to the extended position, forcefully closing the door. This embodiment of the invention has the effect of forcefully slamming the door on an intruder who tries to force the door open. Persons skilled in the art could develop other means of automatically forcefully extending the brace 5 following an impact on the door.

FIG. 10 shows a third door brace 5 in which the two gas springs 155 are replaced with a single gas spring 230 located within the outer tube 10. The gas spring 230 includes a cylinder section 235 which is attached to the outer tube 10 with a bolt 240. The gas spring 230 also includes a piston rod 245 which is attached to the inner bar 15 at a threaded section 250. Movement of the lever 45 to the retracted position causes the inner bar 15 to slide further into the outer tube 10, thus compressing the gas spring 230. This compression of the gas spring 230 biases the door brace 5 towards the closed door position. This construction requires only one gas spring 230, which is concealed within the brace 5. Another type of spring, such as a coil spring, could be used.

Figure 11:
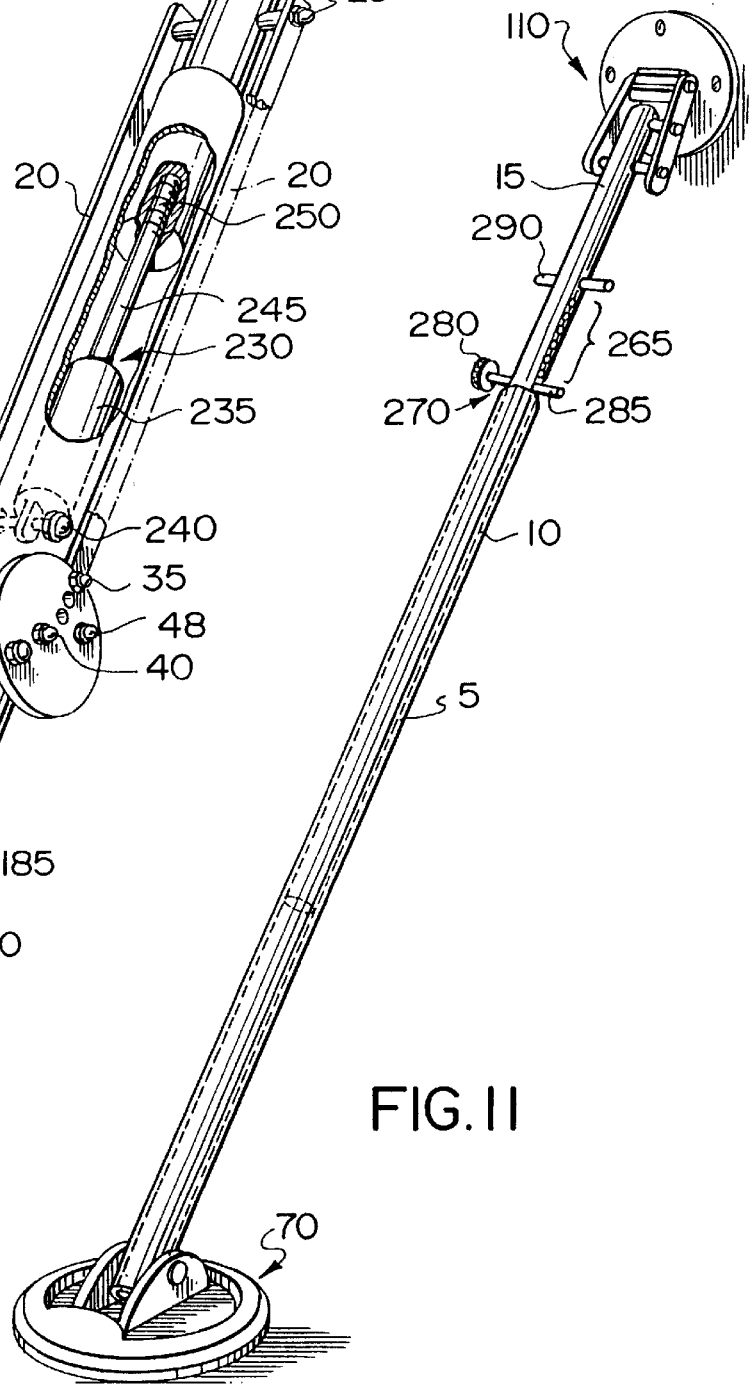
FIG. 11 is a perspective view of a fourth door brace.

FIG. 11 shows a fourth door brace 5 which includes an inner bar 15 slidable within an outer tube 10, but does not include means for urging the inner bar 15 toward the extended position. Instead, the length of the inner bar 15 is adjusted by inserting a pin 270 into any one of the adjustment holes 265 .

In operation, the pin 270 is inserted into the appropriate adjustment hole 265 to maintain the door in the closed position. The door cannot be opened because the outer tube 10 contacts the pin 270. If it is desired partially to open the door, the pin 270 is removed, allowing the door to be opened and the inner bar 15 to be slid into the outer tube 10 until the outer tube 10 contacts the stop 290, which is fixed to the inner bar 15. If it is desired to open the door a lesser amount, another pin could be inserted into an adjustment hole 265 prior to removing pin 270 for opening the door. Although the brace 5 cannot force the door to the closed position, further opening of the door is prevented unless the brace 5 is disengaged from the door and/or the floor.

Figure 13:
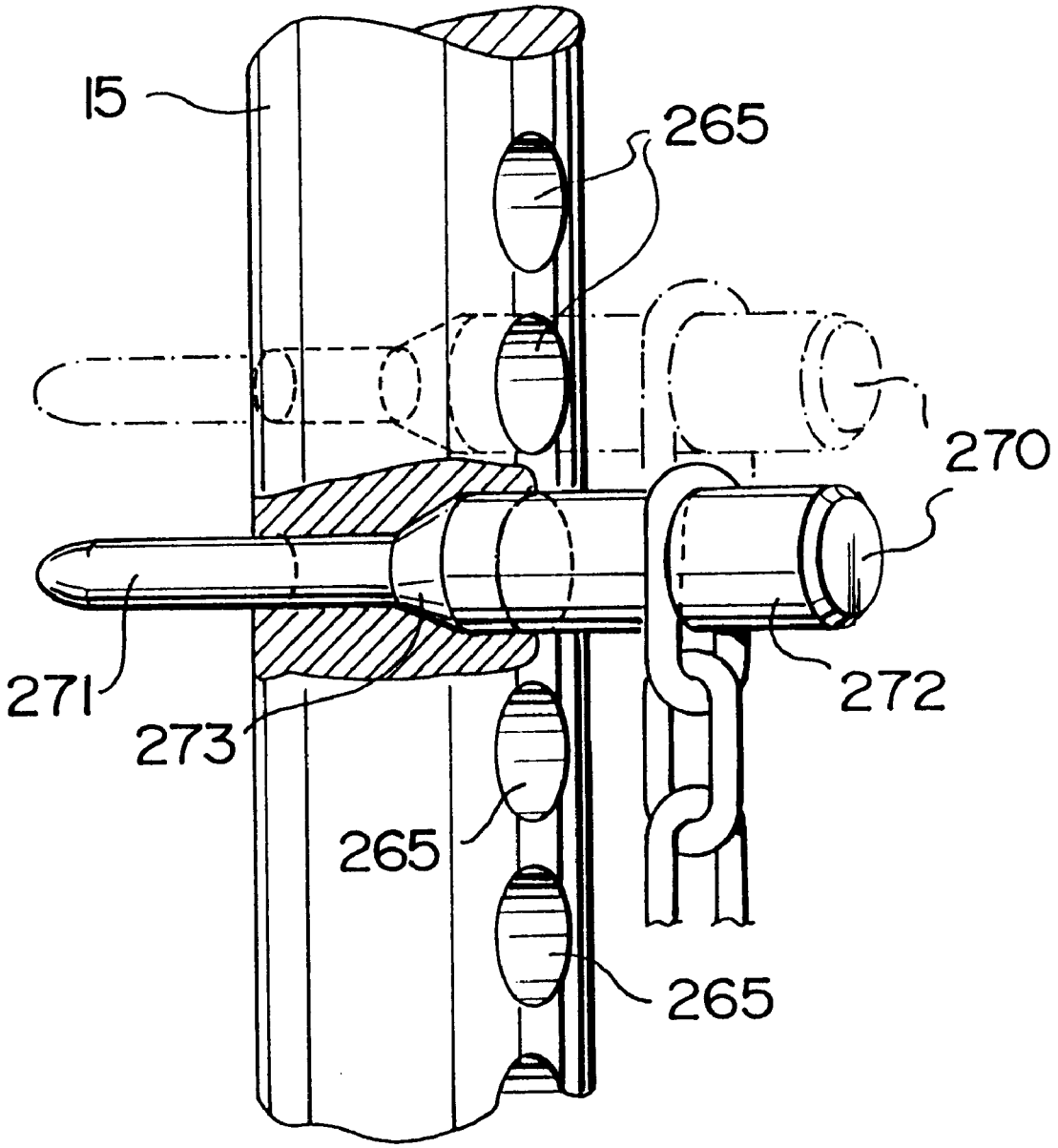
FIG. 13 is a perspective view of part of a sixth door brace.

Advantageously, the pin 270 may be shaped so as to force the brace 5 tightly against the door when securing the door in the closed position, as illustrated in FIG. 13. The pin 270 of FIG. 13 includes a thin section 271, a thick section 272, and a tapered section 273 located between the thin section 271 and the thick section 272. In operation, insertion of the thick section 272 into one of the holes 265 is made possible by the tapered section 273, and has the effect of slightly yet forcefully extending the brace 5 against the door by extending the inner bar 15 further out from the outer tube 10 when securing the door firmly in the closed position as any slack in the brace 5 is eliminated.

Numerous modifications, variations and adaptations may be made to the particular embodiments of the invention described above without departing from the scope of the invention, which is defined in the claims. The following are some examples of the many such modifications, variations and adaptations. Firstly, the brace could be constructed so as to operate in conjunction with a door that opens outwards. Secondly, the lever mechanism can be replaced by a piston/cylinder arrangement or a screw driven by a crank or motor. Thirdly, the discs could be replaced by components of various shapes, or the connectors could be attached directly to the lever. Fourthly, the manually operable pin of the fourth embodiment could be replaced by a ratchet mechanism.

I claim:

1. A door brace for bracing a door against a fixed object, in a closed position, and for permitting a said door to be at least partially opened without removal of said brace, comprising:

i) an elongate member of variable length comprising a hollow tube having a bar coaxially slidable therein from a first, retracted position to a second, extended position, whereby said elongate member can assume a first, retracted length, and a second, extended length;

ii) first anchor means constructed and arranged to secure a first end of said elongate member to a said door;

iii) second anchor means constructed and arranged to secure a second end of said elongate member to a fixed object;

iv) a lever pivotable about a selected mount on a selected one of said tube or said bar of said elongate member, linked by at least one connector to the other of said tube or said bar adjacent said first end of said elongate member; and v) linkage means between said lever and said at least one connector, said lever being movable from a first position in which said connector is retracted, and said bar is retracted in said tube to a second position in which said connector is extended, and said bar is extended from said tube.

2. A door brace as claimed in claim 1, wherein said linkage means comprises at least one disc mounted on a selected one of said tube or said bar at said selected point thereof and affixed to said lever, whereby pivoting of said lever causes rotation of said disc, said at least one connector being pivotally affixed to said disc at a point spaced from said lever.

3. A door brace as claimed in claim 2, wherein said lever comprises a pair of arms, one on each side of said elongate member, and one said connector and one said disc is provided on each side of said elongate member cooperable with one of said arms of said lever.

4. A door brace as claimed in claim 3, wherein said lever is pivotable about a selected point on said tube.

5. A door brace as claimed in claim 4, further comprising an axle extending through said tube at said selected point, on which said discs and said lever are mounted.

6. A door brace as defined in claim 5, further comprising energy storage means biasing the elongate member towards the second length.

7. A door brace as defined in claim 6, wherein the energy storage means comprises a gas spring having a first end attached to the disc and a second end attached to the elongate member, whereby movement of the elongate member from the second length to the first length causes the gas spring to compress.

8. A door brace as defined in claim 6, further comprising restraining means for releasably fixing the elongate member at the first length, the restraining means comprising:

a collar axially slidable on the elongate member;

a clip attached to the collar for releasably receiving the lever.

9. A door brace as defined in claim 8, wherein:

the lever comprises a first pin mounted perpendicularly to the elongate member; and the clip includes a cylindrical hook adapted to releasably receive the first pin.

* * * * *